United States Patent [19]

Lavon

[11] 4,123,108

[45] Oct. 31, 1978

[54] METHOD AND DEVICE FOR BREAKING A HARD COMPACT MATERIAL

[75] Inventor: Erik V. Lavon, Saltsjo-Boo, Sweden

[73] Assignee: Atlas Copco Aktiebolag, Nacka, Sweden

[21] Appl. No.: 720,122

[22] Filed: Sep. 3, 1976

[30] Foreign Application Priority Data

Sep. 19, 1975 [SE] Sweden ..... 7510559

[51] Int. Cl.[2] ..... E21C 37/06

[52] U.S. Cl. ..... 299/16; 241/1; 299/20

[58] Field of Search ..... 299/13, 16, 17, 67, 299/20; 102/22, 23; 175/3, 5; 166/177, 299; 239/101; 241/1, 32

[56] References Cited

U.S. PATENT DOCUMENTS

| | | | |
|---|---|---|---|
| 2,840,360 | 6/1958 | Jerusel | 299/16 X |
| 2,867,426 | 1/1959 | Dowie | 299/16 |
| 3,704,966 | 12/1972 | Beck | 239/101 |
| 3,729,137 | 4/1973 | Cobb et al. | 299/17 |
| 3,988,037 | 10/1976 | Denisart et al. | 299/16 |

FOREIGN PATENT DOCUMENTS

| | | | |
|---|---|---|---|
| 20,445 of | 1912 | United Kingdom | 299/13 |

*Primary Examiner*—Ernest R. Purser
*Attorney, Agent, or Firm*—Flynn & Frishauf

[57] ABSTRACT

A hard compact material, such as rock, is broken by forcing a longish mass body of relatively incompressible fluid, such as water, against the material to be broken. The mass body is directed into a hole in the material for impacting a surface therein. Prior to the impact delivering the mass body is accelerated to an impact velocity of sufficient magnitude for causing cracks to form in the material. Further, cracks in the hole are propagated toward a free surface in the material by the effect of the momentum or kinetic energy of the mass body.

23 Claims, 8 Drawing Figures

13
26
23
24

13
26
25

METHOD AND DEVICE FOR BREAKING A HARD COMPACT MATERIAL

BACKGROUND OF THE INVENTION

This invention relates to a method and apparatus for breaking a hard compact material especially rock, by means of relatively incompressible fluid, such as water.

Conventional methods of rock breakage, including drill-and-blast and crushing techniques have several disadvantages.

The drill-and-blast technique has the disadvantage of noise, gases, dust and flying debris, which means that both men and machines must be evacuated from the working area. Crushing techniques require large forces to crush the rock and the tool wear is significant.

During the last decade serious attention has been given to replacing the drill-and-blast technique for tunnelling, mining and similar operations. One alternative technique involves the use of high velocity jets of water or other liquid to fracture the rock or ore body and numerous devices intended to produce pulsed or intermittent liquid jets of sufficiently high velocity to fracture even the hardest rock have been suggested. Such devices are disclosed in for example U.S. Pat. Nos. 3,521,820; 3,784,103 and 3,796,371. For hard kinds of rock the jet impinging velocity necessary to break the material is typically 2000 meters/sec. As yet, however, jet cutting techniques are still unable to compete with the traditional methods of rock breakage such as drill-and-blast in terms of advance rate, energy consumption or overall cost. Moreover serious technical problems such as the fatigue of parts subjected to pressures as high as 10 to 20 kbar and excessive operational noise remain.

A second and even older technique for fracturing the rock and for saturating soft rock formations such as coal with water for dust suppression involves drilling a hole in the rock and thereafter pressurizing the hole with water either statically or dynamically. This second technique is described in for example German Pat. No. 241,966. According to this patent water is supplied to a hole pre-drilled in the coal stope for saturating the stope until the pores in the wall of the hole are substantially water-filled. The water supply into the hole is then increased stepwise. The stope cannot absorb this suddenly supplied large water quantity and a breaking force therefore arises in the drill hole. Due to the small breaking forces which are obtainable by this technique only soft material, such as coal, can be broken.

The object of the invention to achieve a hydraulic blasting technique which makes it possible to break compact material, such as rock, by using equipment which operates at comparatively low pressures.

It is to be understood that the term "fluid" used in the claims means a relatively incompressible substance that alters its shape in response to any force, that tends to flow or to conform to the outline of its container, and that includes liquids, plastic materials and mixtures of solids and liquids capable of flow. As example of such substance can be mentioned water, lead and plasticine.

BRIEF DESCRIPTION OF THE DRAWINGS

The invention is described in the following description with reference to the accompanying drawings in which various embodiments are shown by way of example. It is to be understood that these embodiments are only illustrative of the invention and that various modifications thereof may be made within the scope of the claims following hereinafter.

In the drawings.

DETAILED DESCRIPTION OF PREFERRED EMBODIMENTS

Figure 1:
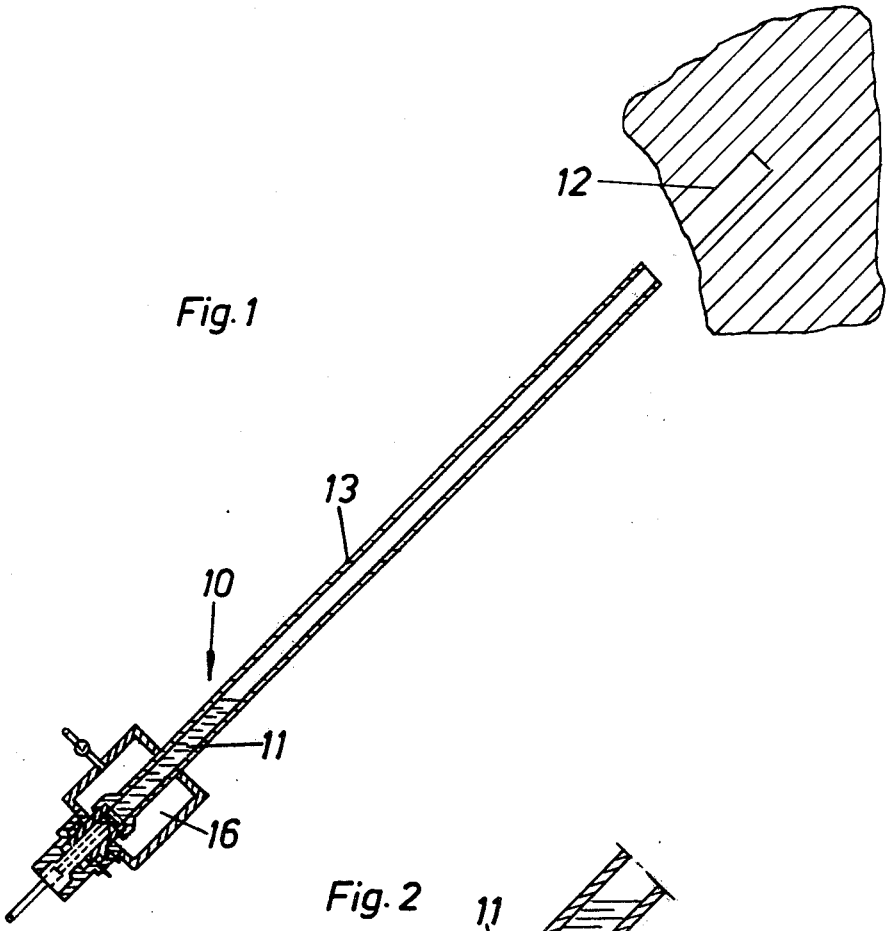
FIG. 1 is a sectional side view of an apparatus according to the invention.

Corresponding details have been given the same reference numeral in the various figures.

Figure 2:
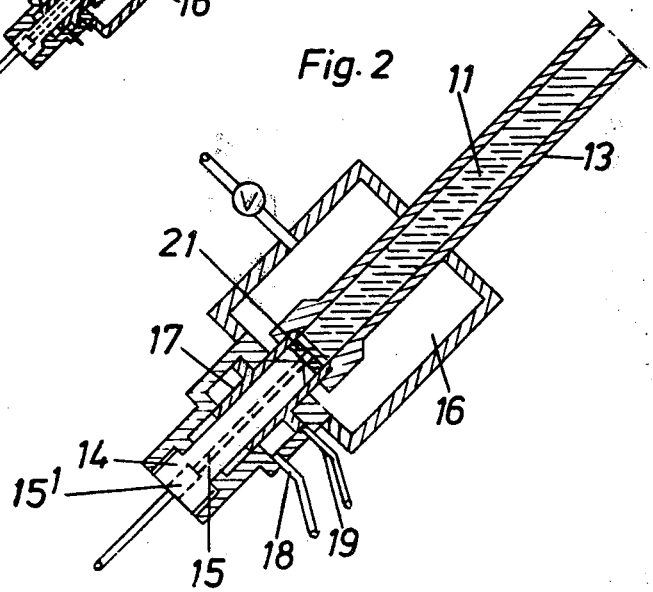
FIG. 2 is an enlarged section of a portion of the apparatus in FIG. 1.

In FIGS. 1 and 2 is shown a gun generally depicted 10 for forcing or launching fluid in form of a longish coherent mass body or column 11 into a pre-drilled, cylindrical blind hole 12. The blind hole 12 is drilled by using conventional technique. In the illustrated embodiment the mass body or fluid piston column consists of water; however, other types of fluid may be used. The gun 10 comprises a barrel 13. The barrel 13 is centered relative to the hole 12 having its mouth just in front of the opening of the hole. A back head 14 is screwed into the rear part of the gun 10. The back head 14 is provided with a passage 15 traversing therethrough. The fluid is filled into the barrel 13 through the passage 15. A check valve 15[1] in the passage 15 prevents the fluid from flowing out of the barrel 13. A charge chamber 16 for power fluid is arranged around the rear portion of the barrel 13. The power fluid which consists of pressure air or any other pressure gas is used for accelerating the fluid piston 11. In FIGS. 1 and 2 a plate 21 is inserted between the power fluid and the fluid piston 11. The plate 21 is intended to keep the fluid piston unchanged in shape by preventing so-called fingers from arising which may occur when high pressure air is caused to act upon a water surface. The plate 21 may be inserted into the barrel 13 by unscrewing the back head 14. The fluid is then admitted through the passage 15 and a hole in the plate 21 which is concentric with the passage. Alternatively the plate 21 may be designed without any hole; in such case the fluid may be admitted through a conduit, not shown, which extends radially relative to the barrel 13. Under certain circumstances the plate 21 may be omitted. By making the fluid piston of sufficient length and by controlling the supply of pressure air in suitable manner by means of a valve slide 17 it is possible to limit the extension of the above-mentioned fingers thereby making it possible to accelerate the fluid piston without using the plate 21. The valve slide 17 can be shifted by supplying control air to either of two passages 18, 19. By shifting the slide 17 from the position shown in FIG. 2 the pressure gas in the chamber 16 is caused to act upon the rear end face of the fluid piston 11 via the plate 21. The fluid piston 11, thus, is accelerated. A continued acceleration of the fluid piston 11 occurs during its transport through the barrel 13 due to the expansion of the pressure gas in the chamber 16. When the accelerated fluid piston leaves the barrel 13 it is launched into the hole 12. The volume of air in the barrel 13 which is in front of the fluid piston 11 is vented through the gap between the barrel and the rock.

When the fluid piston hits the bottom of the hole a high pressure is instantaneously generated in the piston; during ideal state of flow the so-called liquid impact pressure $$P = \rho C V$$

where $\rho$ is the density of the fluid, $C$ is the speed of sound in the fluid and $V$ is the velocity of the fluid when it strikes the bottom of the hole.

This pressure will act upon the bottom and envelope surfaces of the hole and if the pressure exceeds the one-dimensional ultimate tensile strength of the material cracks are caused to form in these surfaces.

The cracks are propagated further if the fluid is caused to flow into and fill up the cracks during continued pressurization; the kinetic energy or momentum of the fluid piston is then successively consumed, however, a lower and lower pressure is required for continued propagation of the cracks as the area of the cracks increases.

Complete loosening or break occurs when at least three cracks are propagated until they cross a free surface, i.e. reach the surroundings of the material.

For complete breakage is therefore required on the one hand a sufficiently high pressure in the hole, i.e. a certain minimum velocity of the fluid piston, and on the other a sufficient quantity of fluid so that a large enough number of cracks can be driven towards the free surface against which breakage is to be carried out. Since the diameter of the fluid piston preferably is about the same as that of the hole the latter requirement means that the fluid piston must have a length exceeding a certain value which depends on the depth of the hole, burden and spacing or distance between the holes.

The kinetic energy of the fluid piston can be represented by the equation $$E = \rho/2 \cdot A \cdot L \cdot V^2$$

where $\rho$ is the density of the fluid piston $A$ is the cross section area of the fluid piston $L$ is the length of the fluid piston and $V$ is the velocity of the fluid piston.

Therefore, the condition for complete loosening or breakage can be expressed by stipulating the requirement for a certain velocity and a certain kinetic energy of the fluid piston.

In order to emphasize the importance of a large mass of the fluid piston the condition for complete breakage can alternatively be expressed by stipulating, besides the necessary velocity, the requirement for a certain momentum, i.e. the product of the mass of the fluid piston and its velocity.

In practice the required pressure in the hole and the required energy is influenced by several other factors. The required pressure is as a rule lowered by the presence of natural crack formations in the material, while at the same time a larger quantity of fluid, i.e. a larger amount of energy must be supplied in order to compensate the leakage through these natural cracks.

Furthermore, the greater the constrictions on the material being broken, higher pressure and more energy is required to drive the cracks. For example, for rock breakage, larger pressure and more energy is required for crater blasting when compared to bench blasting.

The values of velocities of the fluid piston when water is used are typically 100 to 300 meters/sec. and the values of kinetic energies are typically 500 to 20000 joule. In order to obtain a large enough mass, the fluid piston should preferably be a length of 0.2 to 2.0 meters; the optimum length depending on factors such as hole depth, hole diameter and burden.

When the invention is practiced it is usually desired that cracks are initiated at the bottom of the hole and that they are propagated therefrom so as to loosen as much material as possible.

In this connection, however, two difficulties exist. If the material is of uniform strength and if the hole is made without sharp-edged bottom and corners which cause local stress concentration, then cracks will be initiated accidentally in the hole over the whole sphere of action of the pressure. The cracks which are closest to the mouth of the hole will thereafter be able to propagate easiest since the thinner the material layer between the crack and the mouth of the hole is, the less force is required for deformation. The result is that breaking from the full depth of the hole cannot be obtained.

This difficulty could possibly be overcome by making the hole such that the transition between bottom and wall of the hole becomes so sharp that a local stress concentration is obtained which means that cracks would be initiated at and propagated from this zone upon pressurization. The condition precedent for this is that the remainder of the material is homogenous and equal in strength. However, that is seldom the case in practice and particularly not at rock breaking, where the occurence of older naturally occurring cracks disturb the process.

One way of avoiding these two difficulties is to insert the barrel into the hole to about at least half the depth of the hole.

Figures 3, 8:
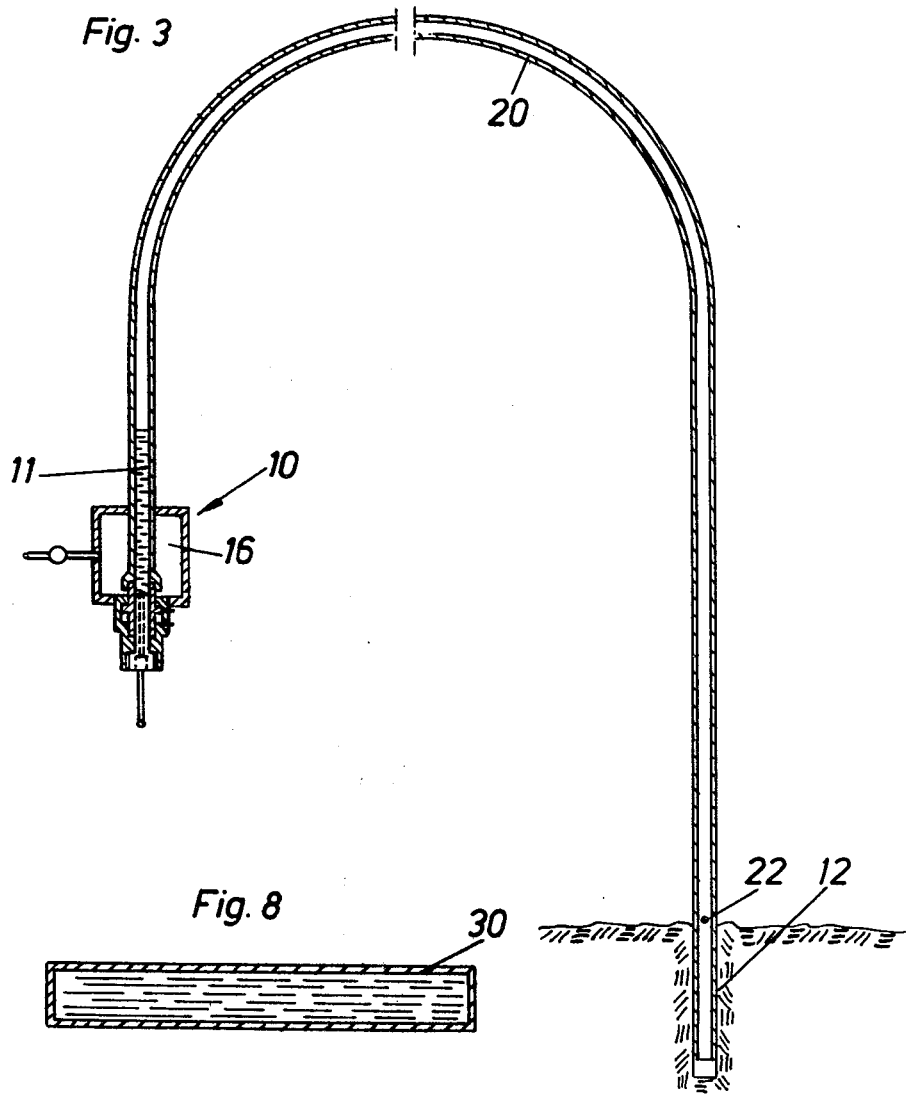
FIG. 3 shows another embodiment of an apparatus according to the invention.
FIG. 8 shows an embodiment of a projectile intended to be used in an apparatus according to the invention.

The propagation of the cracks which are in the vicinity of the bottom of the hole then take precedence since the fluid has to turn and overcome a flow resistance before it can reach the cracks which are outside the mouth of the barrel. Such a mode of breaking is illustrated in FIG. 3 which shows an embodiment of the invention wherein the hole 12 can be oriented arbitrarily relative to the gun 10. The barrel of the gun 10 is designed as a tube. For the rest the gun 10 is designed as shown in FIG. 2. The tube 20, preferably flexible, is inserted into the hole 12. The fluid piston 11 is accelerated by means of the power gas in the chamber 16 toward the bottom of the hole. The volume which is confined by the fluid piston 11 and the bottom of the hole is vented through a bore 22. Alternatively the venting may be carried out along the outside of the tube 20 between the tube and the wall of the hole. The tube 20 which consequently has an external diameter that is smaller than the diameter of the hole is suitably provided with outer centering flanges at least at its forward end. In addition to venting along the outside of the tube 20, venting may also be carried out through one or several openings in the tube 20. Furthermore venting may be carried out only through one or several openings in the tube 20. Venting may also be carried out by means of a device for air suction which is arranged around the tube 20 at the opening of the drill hole.

The axial position of the tube 20 in the hole 12 may be varied. Particularly the mouth of the tube 20 may be arranged just in front of the opening of the hole. The barrel 13 of the gun 10 shown in FIG. 1 may be inserted into the hole 12 to a varying hole depth. Venting may be carried out according to any of the manners mentioned in connection with FIG. 3.

Figure 4:
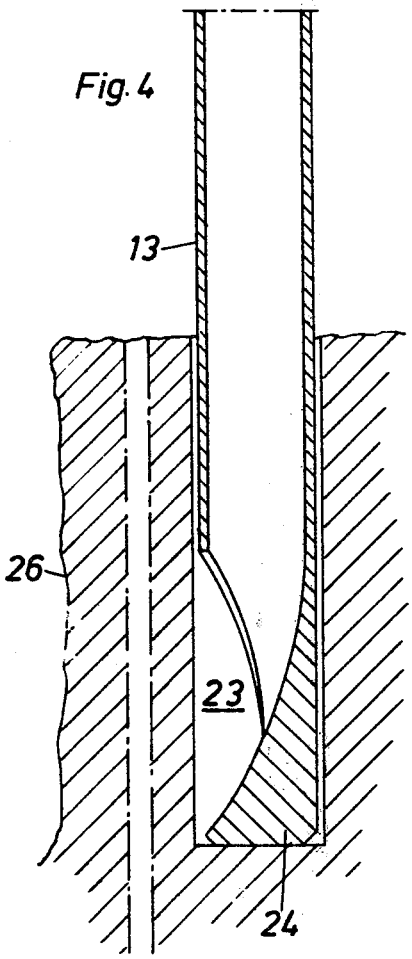
FIGS. 4 and 5 show alternative embodiments for obtaining fracture in a desired direction of an apparatus according to the invention.

FIG. 4 shows an embodiment of the barrel 13 (or the tube 20) where a directed fracture or break effect is achieved. Directed fracture may be used to advantage when the breaking is carried out as bench blasting where break occurs toward a free surface 26 in the bench. The barrel 13 is partly cut off at its forward end for providing a sidewards directed outlet opening 23. The side of the tube 13 opposed to the outlet opening 23 is designed as a deflector plug 24. In conformity with the mode of operation where the barrel is inserted into the hole the propagation of cracks is taking precedence in the direction where the outlet opening points. The outlet opening is thus directed towards the free surface against which break is desired. This results in more efficient use of the energy of the fluid piston.

Figure 5:
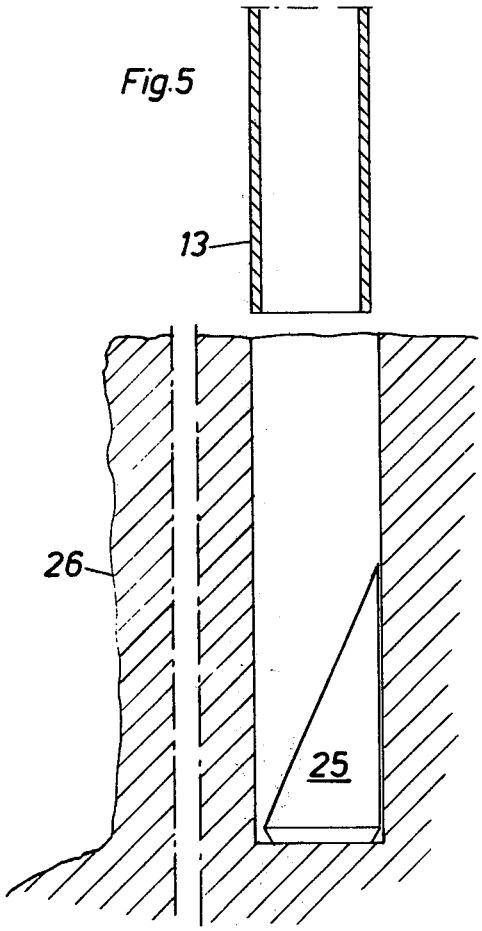

FIG. 5 illustrates an alternative embodiment for obtaining directed fracture effect. Instead of being integrally united with the barrel 13 the deflector plug is designed as a separate unit 25 which is inserted into the drill hole to its bottom.

The device shown in FIG. 4 may be modified in different ways for obtaining fracture effect in a desired direction. By omitting the plug 24 propagation of cracks preferentially proceeds downward as well as sideward due to the opening 23. By arranging several openings around the periphery of the barrel 13 fracture effect is obtained in an optional number of directions.

When using comparatively easy-flowing fluids it may sometimes be difficult to ensure that the fluid completely or at least mostly acts as a piston when it is launched into the pre-drilled hole, especially if the hole is deep relative to its diameter. FIG. 8 shows an embodiment which removes this difficulty. The fluid is encapsulated in a cover 30 made of any material which easily bursts under the pressure arising when the fluid piston impacts the bottom of the hole. Typical material is cardboard and plastics. According to a further modified embodiment the fluid piston may be provided with a rear limitation plate as shown in FIGS. 1 and 2, and a forward plate. The forward plate is then intended to keep the forward end face of the piston unchanged in shape so as to ensure that the required impact force is obtained when the piston hits the bottom of the drill hole.

Figure 6:
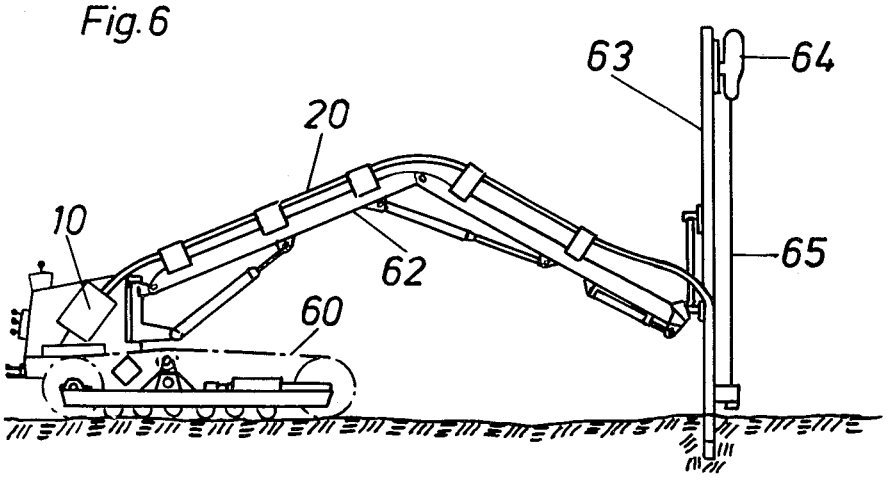
FIG. 6 shows diagrammatically a side view of a mobile rig carrying an apparatus according to the invention.
Figure 7:
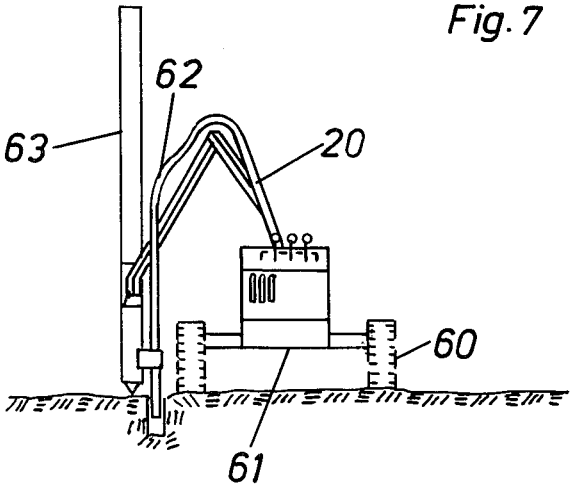
FIG. 7 shows diagrammatically a rear view of the rig in FIG. 6.

FIGS. 6 and 7 show diagrammatically a rig for carrying the device shown in FIG. 3. The rig comprises a chassis 61 provided with crawlers 60. The rig supports a folding boom 62 which can be swung as well as elevated and lowered relative to the chassis 61. The folding boom 62 carries a feed bar 63 at its free end. A mechanically fed rock drilling machine 64 is reciprocably guided along the feed bar. The rock drilling machine delivers impacts against a drill rod 65 during simultaneous rotation thereof.

The chassis 61 also carries the gun 10. The tube 20 extends along the boom 62 and is connected therewith for taking up the forces of inertia produced during the propulsion of the fluid piston through the tube. The forward end of the tube 20 is connected to the feed bar 63. The tube is mounted on the feed bar in such way that it projects past the feed bar a distance corresponding to the length of the tube which is intended to be inserted into the drill hole. The feed bar is forced against the rock surface such that the urging force exceeds the force of reaction acting on the tube during the propulsion of the fluid piston. The spur on the feed bar intended to rest against the rock is mounted on the end of the piston rod of a hydraulic cylinder.

The machine works in the following manner. A hole is drilled by means of the rock drilling machine 64 in the material to be broken. The mouth of the tube 20 is then directed toward a surface in the drill hole by means of the adjusting device comprising the folding boom 62, the feed bar 63 and associated hydraulic cylinders. A fluid piston is accelerated by means of the accelerating device (gun) 10 to a velocity which is required for causing cracks to form in the material and is directed into the pre-drilled hole.

The apparatus shown in FIGS. 6 and 7 can of course be used for obtaining the directional fracture effect illustrated in FIGS. 4 and 5. The deflector plug 25 shown in FIG. 5 may then be attached to the feed bar 63 so that it is inserted into the hole at the same time as the tube 20 is aligned with the hole.

Several experiments have been made with the above-described devices. It is then observed that it was possible to considerably decrease the necessary power pressure in the charge chamber if directional fracture effect (FIGS. 4 and 5) was made use of. When conducting one test equipment shown in FIGS. 1 and 5 was used wherein the length of the barrel 13 was 1200 mm. The barrel 13 was directed about 45° upwards seen from the horizontal plane. The depth of the hole 12 was 160 mm and its diameter was 41 mm. The ratio between the diameter of the barrel and the hole was 0.78. Bench blasting was carried out where the burden was 250 mm by means of a water piston having a length of 500 mm and a power pressure in the chamber 16 of 100 bar.

The above theory regarding the conditions which must be met in order to obtain accurate breakage does not consider the effect caused by compression of the air volume enclosed between the fluid piston and the bottom of the hole. Studies of the pressure in simulated drill holes indicate that a possible compression of the enclosed air volume affects the breaking process favorably, particularly concerning the generating of cracks which are required for the breaking. This compression effect is decreased the smaller the relative area ratio between the fluid piston and the hole is.

It has been found that accurate breakage is obtained if the fluid piston has a cross section diameter of between 70–100% of the free cross section diameter of the hole. By free cross section diameter is meant the diameter of an empty hole or the inner diameter of the barrel or tube in case same is inserted into the hole. Advantageously the diameter of the fluid piston should be more than 90% of the free cross section diameter, preferably substantially equal thereto.

The invention may also be applied to advantage for obtaining delay interval breaking. By varying the length of the tube between the gun and the hole the desired delay interval is obtained. Where the burden is between 200 mm and 400 mm the suitable interval can be estimated to lie between 1 millisec and 2 millisec. If the velocity of the water piston is 200 meters/sec. this means that the lengths of the tubes are varied such that the step is between 0.2 m and 0.4 m.

What I claim is:

1. A method of breaking a hard compact material, such as rock, comprising:

mechanically pre-drilling at least one substantially cylindrical blind hole in the material to be broken, said material having free surfaces adjacent said hole, accelerating an elongated mass body of substantially incompressible fluid to an impact velocity sufficient to cause cracks to form in the material, the smallest cross sectional dimension of said elongated mass body being at least 70% of the free cross sectional diameter of said hole, and directing said elongated mass body into said pre-drilled hole for impacting the bottom thereof, and forming said elongated mass body of a length sufficient to break the material towards adjacent free surfaces of the material by means of the momentum of said elongated mass body.

2. A method according to claim 1, comprising forming said elongated mass body as a fluid piston prior to its impact against the material to be broken.

3. A method according to claim 2, wherein said fluid is water and comprising accelerating the fluid in form of a water piston to a velocity in the order of 100 to 300 meters/sec.

4. A method according to claim 3, wherein the water piston has a length of 0.2 to 2.0 meters.

5. A method according to claim 1, comprising directing said elongated mass body into the hole through a tube inserted therein.

6. A method according to claim 5, comprising accelerating said elongated mass body to said impact velocity in said tube.

7. A method according to claim 5, wherein the tube is inserted into the hole.

8. A method according to claim 1, comprising deflecting said elongated mass body wholly or partially laterally to impact a portion of the wall of the hole.

9. A method according to claim 1, wherein said elongated mass body is at least partially confined by a capsule.

10. A method according to claim 1, wherein said elongated mass body has a given length.

11. A method according to claim 1, wherein the smallest cross sectional diameter of said elongated mass is more than 90% of the free cross sectional diameter of said pre-drilled hole.

12. A method according to claim 11, wherein said smallest cross sectional diameter is substantially equal to said free cross sectional diameter.

13. A method of breaking a hard compact material, such as rock, comprising:

pre-drilling at least one hole in the material to be broken;

inserting an end of an elongated hollow tubular member at least partially into said pre-drilled hole;

locating an elongated mass of substantially incompressible fluid of given length in said elongated tubular member remote from said hole;

introducing a pressurized pressure fluid which is substantially more compressible than said substantially incompressible fluid of said elongated mass behind said elongated mass and more remote from said hole to accelerate said elongated mass in said elongated tubular member towards said hole substantially wholly under the influence of the pressure of said pressurized pressure fluid and continuing to accelerate said elongated mass during at least part of its movement through said elongated tubular member due to expansion of said pressure fluid in said elongated tubular member behind said elongated mass; and directing said accelerated elongated mass into said pre-drilled hole by said end of said tubular member for impacting a surface in said hole so as to break the material by means of the momentum of said elongated mass.

14. A method according to claim 13 wherein said substantially incompressible fluid is water and said pressurized pressure fluid is compressed air.

15. A method according to claim 13 wherein the smallest cross section dimension of said elongated mass is between 70–100% of the free cross section diameter of said pre-drilled hole.

16. A method according to claim 15 wherein the smallest cross section diameter of said elongated mass is more than 90% of the free cross section diameter of said pre-drilled hole.

17. A method according to claim 16 wherein said smallest cross section dimension is substantially equal to said free cross section diameter.

18. A method according to claim 13 wherein the tube is inserted in the hole substantially to the vicinity of the bottom of the hole.

19. A method of breaking a hard compact material, such as rock, comprising:

pre-drilling at least one hole in the material to be broken, accelerating an elongated mass body of given length and of substantially incompressible fluid to an impact velocity sufficient to cause cracks to form in the material, and directing said elongated mass body into said pre-drilled hole for impacting a surface therein to break the material by means of the momentum of said elongated mass body.

20. A method according to claim 19 comprising using water as said substantially incompressible fluid.

21. Apparatus for breaking a hard compact material, such as rock, having a pre-drilled hole formed therein, comprising:

a chamber for storing a substantially incompressible fluid, a barrel (13) coupled to said chamber, means coupled to said chamber for forcing said fluid in the form of an elongated mass body into said hole through said barrel, means for directing said barrel toward an internal surface of said hole, said directing means causing the mouth of said barrel to be inserted into said hole, and a deflector plug in said hole and associated with said barrel for deflecting said elongated mass body laterally toward a portion of the wall of the hole, said forcing means including means for accelerating said elongated mass body to a velocity of sufficient magnitude for causing cracks to form in the material upon impact against an internal hole surface of said hole.

22. Apparatus according to claim 21, wherein said barrel and deflector plug are an integral unit and comprise a sidewards directed outlet opening, said outlet opening being opposed to said deflector plug and serving as the mouth of said barrel.

23. Apparatus according to claim 21, wherein said barrel has venting means for venting the air volume in front of said elongated mass body in said barrel.

* * * * *